US005590422A

United States Patent [19]

Henderson

[11] Patent Number: 5,590,422

[45] Date of Patent: Jan. 7, 1997

[54] COMBINED HEADBAND AND HAIR-RETAINER

[76] Inventor: Donna J. Henderson, 1405 Jasmine Cir., Rohnert Park, Calif. 94928

[21] Appl. No.: 544,063

[22] Filed: Oct. 17, 1995

[51] Int. Cl.[6] ..... A42C 5/02

[52] U.S. Cl. ..... 2/171; 2/174; 2/209.13; 2/209.14; 2/DIG. 11; 132/273

[58] Field of Search ..... 2/170, 171, 174, 2/181, 207, 209.13, 209.14, DIG. 11; 132/273, 275, 278

[56] References Cited

U.S. PATENT DOCUMENTS

| | | | |
|---|---|---|---|
| D. 344,176 | 2/1994 | Lawrence | D2/875 |
| 4,998,544 | 3/1991 | Obergfell | 132/212 |
| 5,174,312 | 12/1992 | Adams | 132/273 |
| 5,186,186 | 2/1993 | Hamilton | 132/200 |
| 5,233,704 | 8/1993 | Booher | 2/207 |
| 5,239,705 | 8/1993 | Leopold | 2/209.13 |
| 5,293,884 | 3/1994 | Chapman et al. | 132/273 |
| 5,321,854 | 6/1994 | Kronenberger | 2/209.7 |

*Primary Examiner*—Diana Biefeld
*Attorney, Agent, or Firm*—R. Russel Austin

[57] ABSTRACT

A combined hairband and hair-retainer includes an elastic, absorbent headband having a hair retainer attached thereto. The hair retainer is an elongated member which is sufficiently flexible to be deformed by hand from one shape to another sufficiently rigid to retain any shape into which it is formed. Hair is retained by gathering hair into a pony-tail form and twisting the hair-retainer around the pony-tail to retain the hair in this form.

6 Claims, 3 Drawing Sheets

Fig. 1
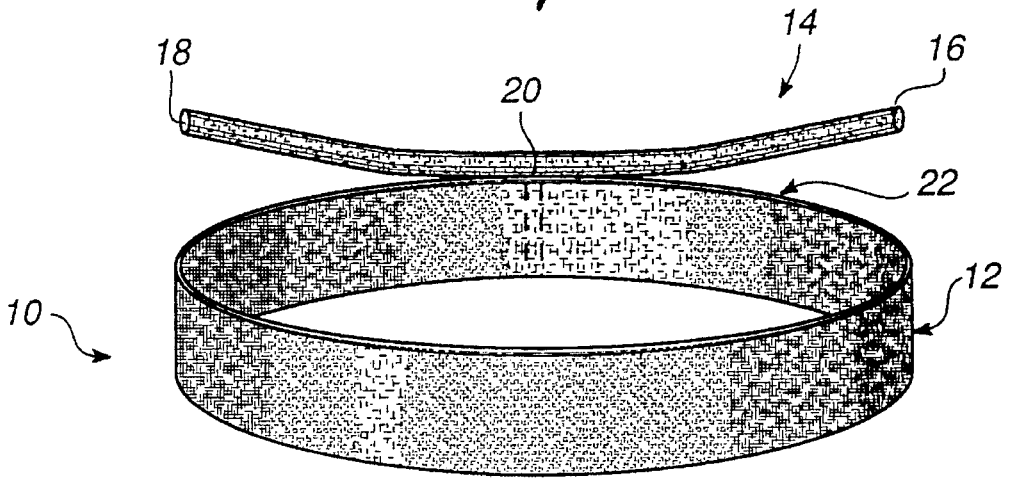
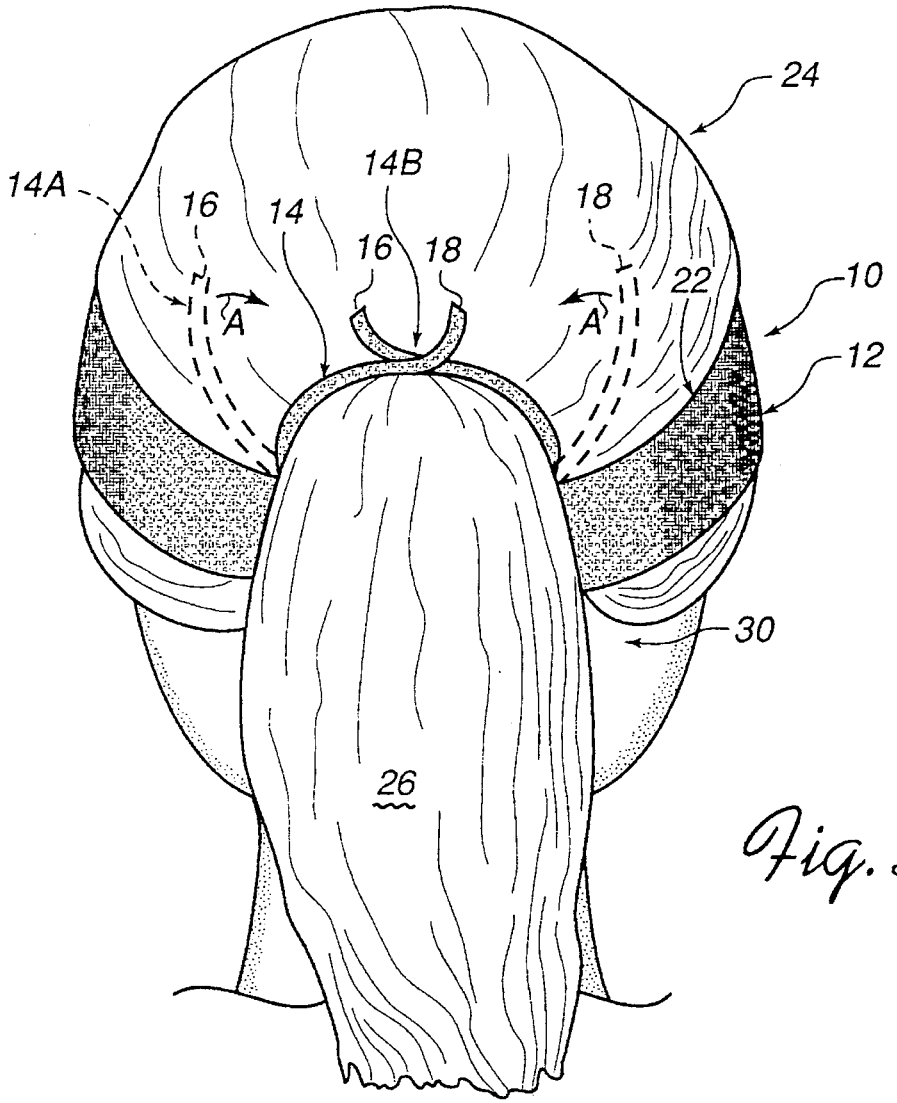
Fig. 2

COMBINED HEADBAND AND HAIR-RETAINER

BACKGROUND OF THE INVENTION

The present invention relates generally to sports headgear. It relates in particular to a headband incorporating a retaining-member for retaining long hair in an orderly fashion.

A person having long hair generally prefers to retain such long hair in an orderly fashion if they are engaged in a vigorous activity such as tennis, running, aerobics and the like. Retaining hair in an orderly manner can prevent distractive motion of the hair or prevent the hair from obscuring vision during the activity. It is also not uncommon for persons engaged in such activities to wear some kind of device for absorbing perspiration from their brow, thereby, for example, preventing the perspiration from reaching their eyes.

Headgear articles have been devised which include a hair retaining function. U.S. Pat. No. 4,998,544, for example, discloses a headband having an aperture therein through which long hair may be passed for retaining the hair in what is commonly termed a "pony-tail". U.S. Pat. No. 5,321,854 discloses a baseball-style cap having a hole in a wall thereof through which hair may be passed to form a pony-tail. U.S. Pat. No. 5,239,705 also discloses a cap having a hole therein through which hair may be passed to form a pony-tail. U.S. Pat. No. 5,174,312 discloses a headband having hingedly coupled combs attached thereto. Long hair is retained by closing the combs thereon, the combs are held in a closed position by a retaining device.

It is believed that the above described devices have certain shortcomings. By way example, while passing or "threading" hair through an aperture in a cap or headband to form a pony-tail may be effective, the threading will generally be difficult to accomplish, as it must be done essentially behind the wearer's head, and out of the wearer's field of vision. In addition, it is also probable that it will be necessary to pull or tug at the hair to complete threading or when removing the device. Further, any device which relies on catches or closure devices for retaining hair invites the possibility of catching or tangling hair in the catch or closure. Pulling hair through an aperture or extricating tangled hair from a catch or closure may be damaging to the hair and painful to the wearer.

SUMMARY OF THE INVENTION

The present invention is directed to providing a combined headband and hair retainer which does not have above-discussed shortcomings of prior art headgear and hair-retainer devices. The present invention is directed in particular to a combined headband and hair-retainer which does not require that hair be passed through an aperture in order to be retained, and does not include any catches, clips or closures which may become tangled in hair.

These and other objects of the present invention are accomplished in an item of apparel comprising a closed-loop including a fabric material and arranged to fit around a wearer's head for forming a headband, and including an elongated hair-retainer member having first and second ends. The hair-retainer member is attached at a region thereof between the first and second ends thereof to the closed-loop. The hair-retainer member is sufficiently flexible that it may be deformed by hand from one shape into another. In use, the closed loop is placed in position on a wearer's head with the hair retainer member formed into a generally straight shape or a widely curved shape. A portion of the wearers's hair is held in contact with the hair-retaining member, and the first and second ends of the hair-retainer member are wrapped or twisted around the hair portion, thereby retaining the hair portion in a pony-tail form.

The closed-loop is preferably a closed-loop band of a resilient fabric. Preferably the fabric is both elastic and absorbent, or the closed-loop is provided with an absorbent liner for absorbing perspiration.

The hair-retainer preferably is formed around a malleable core-portion, the core portion being covered with a fabric which matches or complements fabric of the closed-loop.

BRIEF DESCRIPTION OF THE DRAWINGS

The accompanying drawings, which are incorporated in and constitute a part of the specification, schematically illustrate a preferred embodiment of the invention and, together with the general description given above and the detailed description of the preferred embodiment given below, serve to explain the principles of the invention.

FIG. 1 is perspective view schematically illustrating one preferred embodiment of the present invention including a closed-loop headband having a hair-retainer member attached thereto.

FIG. 2 is a partial view of the rear of a wearer's head schematically illustrating one mode of fitting and wearing the hair-retainer of FIG. 1

DETAILED DESCRIPTION OF THE INVENTION

Figure 3:
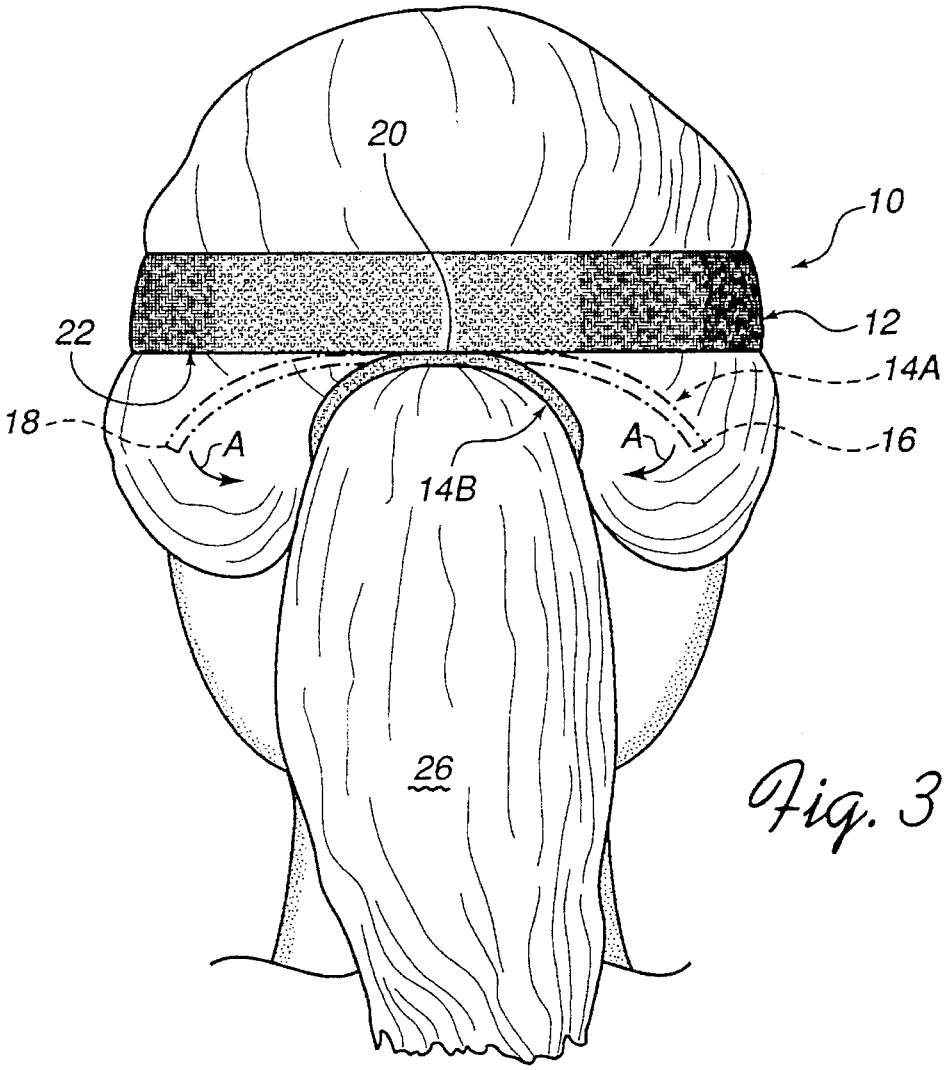
FIG. 3 is a partial view of the rear of a wearer's head schematically illustrating another mode of fitting and wearing the hair-retainer of FIG. 1

Turning now to the drawings, FIG. 1 illustrates a preferred embodiment of an apparel item 10 which is a combined headband an hair-retainer in accordance with the present invention. Apparel item 10 includes a closed-loop 12 of a fabric material. Closed-loop 12 has a circumference selected such that it may be fitted and retained comfortably around a wearer's head. To this end, closed-loop 12 is preferably formed from a resilient, fabric having elastic properties. This provides that a loop of one predetermined size may fit a wide variety of head sizes, while still being sufficiently elastic to be retained on even the smallest head in a range. It is also preferable that fabric forming closed loop 12 be moisture absorbent, so that it can absorb perspiration from a wearer's brow during vigorous activity.

An elongated hair-retainer member 14, having opposite, free ends 16 and 18, is attached at a region 20 thereon, located between ends 16 and 18 thereof, to an edge 22 of closed-loop 12. Hair-retainer 14 preferably has a length about equal to half of the circumference of closed-loop 12. Preferably point 20 is located on a central portion of hair-retainer 14. Hair-retainer 14 can be described as being malleable, i.e., is sufficiently flexible that it may be deformed by hand from one shape to another, yet sufficiently rigid that it will essentially maintain whatever shape into which it is formed. The adverb "essentially" here indicates that some minor lateral restitution of hair-retainer 14 may be inevitable, and that a retained shape may be slightly different from, while being substantially the same as, the shape that existed before a deforming force was removed. It is understood that a particular shape of the hair-retainer will be retained only until another deforming force sufficient to change the shape is applied.

Referring now to FIG. 2, one mode of fitting and wearing combination headband and hair-retainer 10 is illustrated. Here, closed-loop 12 is worn around a wearer's head 24, covering hair at the front of the head (not shown) and sloping downward toward the base 30 of the wearer's head. Edge 22 of closed-loop 12, with hair-retainer 14 attached thereto, is uppermost.

With ends 16 and 18 of hair-retainer 14 widely separated, i.e., with hair-retainer formed into a shape (illustrated in phantom, and designated by general numeral 14A) which is between straight and widely-curved. Hair 26 to be retained is gathered up by the wearer and held, with one hand (not shown), in a pony-tail form in contact with hair-retainer 14. With the other hand (not shown), the wearer closes ends 16 and 18 together as illustrated by arrows A, preferably twisting one end over the other, such that hair-retainer 14 assumes and retains a form designated schematically by general numeral 14B.

Turning now to FIG. 3, another mode of fitting and wearing combination headband and hair-retainer 10 is illustrated. Here, closed-loop 12 is worn around a wearer's head 24, over the wearer's brow (not shown) and generally level about the wearer's head. Edge 22 of closed-loop 12, with hair-retainer 14 attached thereto, is lowermost.

With ends 16 and 18 of hair-retainer 14 widely separated, i.e., with hair-retainer formed into a shape (illustrated in phantom, and designated by general numeral 14A) which is between straight and widely curved. Hair 26 to be retained is gathered up by the wearer and held, with one hand (not shown), in a pony-tail form in contact with hair-retainer 14. With the other hand (not shown), the wearer closes ends 16 and 18 together as illustrated by arrows A, such that hair-retainer 14 encloses and retains the hair as indicated by general numeral 14B, preferably twisting one end over the other, with the twisted ends (not shown) underneath retained hair 26.

Figure 4:
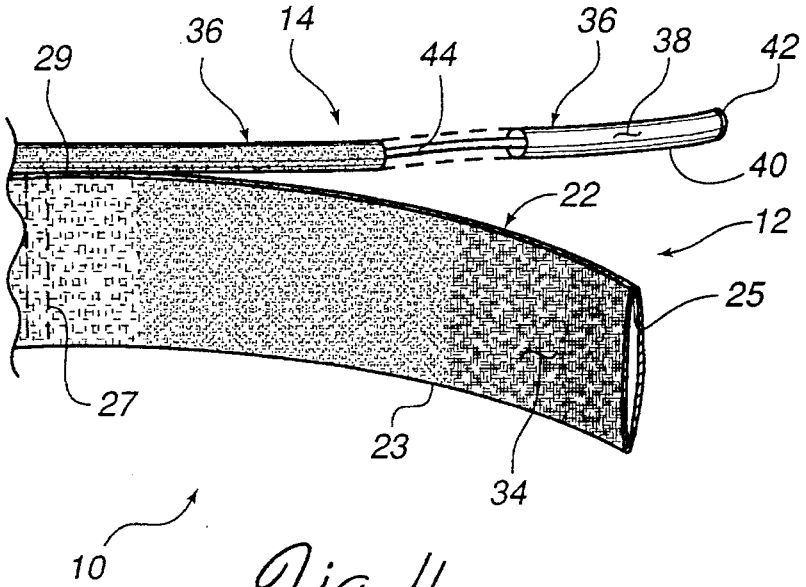
FIG. 4 is a fragmentary partially cut-away perspective view schematically illustrating a preferred construction of the headband and hair retainer of FIG. 1.

Referring now to FIG. 4, a preferred construction of a combined hairband and hair-retainer in accordance with the present invention is shown. In one example of this construction, closed loop 12 was formed from a strip of a five percent LYCRA brand spandes material ninety-five percent cotton fabric, having twice the desired width of the closed-loop, was folded along its width and opposite edges stitched together to form a seam 25. Such a spandex/fabric is available from Nor-Brook Industries Inc. of Carson, Calif.

The stitched-together strip was then turned inside out such that seam 25 was inside folded strip 34 as illustrated in FIG. 4, and opposite ends of the stitched-together strip were stitched together at seam 27 to form closed-loop 12. According to this construction, spandex in the lycra/cotton blend material provides sufficient elasticity in the fabric to retain closed-loop 12 comfortably about a wearer's head, while cotton in the spandex/cotton blend provides desired moisture absorbency.

Figure 5:
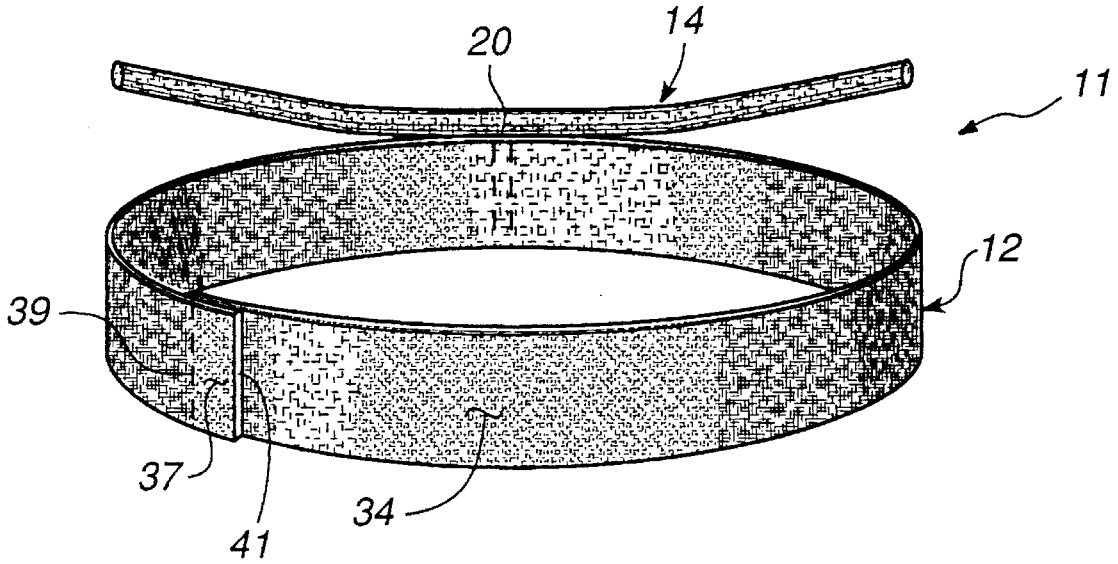
FIG. 5 is a perspective view schematically illustrating another embodiment of the present invention wherein a headband loop is formed from a strip demountably joinable at each end thereof.

One familiar with the art to which the present invention pertains will recognize that folded stiched-together strip may be provided with means at opposite ends thereof to form a demountable attachment between the ends. This may be provided by a hook and loop closure arrangement of the type commonly referred to by the tradename "VELCRO". In FIG. 5, an embodiment 11 of the present invention depicting opposite ends 39 and 41 of strip 34 joined to form such a demountable closure 37 is depicted.

Continuing with reference to FIG. 4, hair-retainer 14 was constructed by forming a tube 36 of the above-described spandex/cotton blend fabric by folding a strip 38 of the fabric along its width, and stitching opposite edges of the strip together via seam 40. One end of fabric tube 36 was closed by a seam 42, the other end was left open. A core 44 of plastic covered copper wire was inserted into the open end of tube 36 and the open end was then stitched closed. The wire of core 44 was a type GA22/2, available from General Cable Inc. of Phoenix, Az. Fabric tube or covering 36 was then stitched to edge 22 of closed-loop 12 at seam 29, thereby attaching hair-retainer 14 to closed-loop (headband) 12.

The malleable, copper wire core 44 is sufficiently flexible that it can be easily deformed by hand from one shape into another, yet is sufficiently rigid that it will essentially retain whatever shape into which it is formed. As fabric tube or covering 36 is sufficiently light that it provides essentially zero resistance to deformation, and does not have any shape-retentive property, hair-retainer 14, fabricated as here described, has essentially the same flexibility and shape retentive properties of malleable core 44 thereof.

It should be noted here that the above-described example is but one example of a construction method for a combined headband and hair-retainer in accordance with the present invention. One familiar with apparel manufacturing art may devise other construction methods without departing from the spirit and scope of the present invention. For example, closed-loop headband 12 maybe formed from a laminate of an absorbent fabric and an elastic material, or may be formed of elastic and absorbent sections which are longitudinally joined to form a closed-loop.

The present invention has been described and depicted in terms of a preferred embodiment. The present invention is not limited however to the embodiment described and depicted. Rather, the present invention is defined by the claims appended hereto.

What is claimed is:

1. An apparel item, comprising:

a closed-loop made at least partially of a fabric material and arranged to fit around a wearer's head for forming a headband; and an elongated hair-retainer member having first and second ends and being attached at a region between said first and second ends thereof to said closed-loop, said hair-retainer member being sufficiently flexible that it may be deformed by hand from one shape into another, yet being sufficiently rigid that it will essentially retain whatever shape into which it is formed, whereby said first and second ends of said hair-retainer member may be wrapped around a portion of a wearer's hair, thereby retaining said hair-portion in a pony-tail form.

2. An apparel item, comprising:

a closed-loop band of a resilient fabric, said closed-loop band arranged to fit around a wearer's head for forming a headband;

an elongated hair-retainer member, said hair retainer-member having first and second ends and being attached at a point between said first and second ends thereof to said closed-loop band; and said hair-retainer member including a malleable core-portion, said core portion being covered by a flexible fabric covering, said core-portion being sufficiently flexible that said hair-retainer member may be deformed by hand from one shape into another, whereby said first and second ends of said hair-retainer member may be wrapped around a portion of a wearer's hair, thereby retaining said hair portion in a pony-tail form.

3. The apparel item of claim 2 wherein said hair retainer member is attached to one edge of said closed loop band.

4. The apparel item of claim 2 wherein said resilient material of said closed loop band is made of a spandex/cotton blend material.

5. An apparel item, comprising:

a strip made at least partially of a fabric material and having first and second ends, said strip joinable at said first and second ends thereof to form a closed-loop, said closed-loop being arranged to fit around a wearer's head for forming a headband; and an elongated hair-retainer member having first and second ends and being attached at a region between said first and second ends thereof to said closed-loop, said hair-retainer member being sufficiently flexible that it may be deformed by hand from one shape into another, yet being sufficiently rigid that it will essentially retain whatever shape into which it is formed, whereby said first and second ends of said hair-retainer member may be wrapped around a portion of a wearer's hair, thereby retaining said hair-portion in a pony-tail form.

6. The apparel item of claim 5 wherein said first and second ends of said strip have hook-and-loop closure components attached thereto for joining said ends.

* * * * *